US006814585B2

(12) United States Patent
Bedell et al.

(10) Patent No.: US 6,814,585 B2
(45) Date of Patent: Nov. 9, 2004

(54) ELECTRICAL CONNECTOR WITH RESILIENT CONTACT

(75) Inventors: Arden C. Bedell, Portland, OR (US); Brett R. Olsen, Minneapolis, MN (US); Matthew L. Gilk, Eagan, MN (US)

(73) Assignee: JohnsTech International Corporation, Minneapolis, MN (US)

( * ) Notice: Subject to any disclaimer, the term of this patent is extended or adjusted under 35 U.S.C. 154(b) by 0 days.

(21) Appl. No.: 10/418,937

(22) Filed: Apr. 18, 2003

(65) Prior Publication Data

US 2003/0232516 A1 Dec. 18, 2003

Related U.S. Application Data

(60) Provisional application No. 60/374,091, filed on Apr. 19, 2002.

(51) Int. Cl.[7] ..... H01R 12/00
(52) U.S. Cl. ..... 439/66; 439/71; 324/755
(58) Field of Search ..... 439/66–68, 71; 324/755

(56) References Cited

U.S. PATENT DOCUMENTS

| | | | | | |
|---|---|---|---|---|---|
| 5,338,232 | A | * | 8/1994 | Bernier | 439/733.1 |
| 5,385,477 | A | * | 1/1995 | Vaynkof et al. | 439/66 |
| 6,062,870 | A | * | 5/2000 | Hopfer et al. | 439/66 |
| 6,079,987 | A | * | 6/2000 | Matsunaga et al. | 439/66 |
| 6,166,615 | A | * | 12/2000 | Winslow et al. | 333/260 |
| 6,224,394 | B1 | * | 5/2001 | Matsumoto | 439/66 |
| 6,264,476 | B1 | * | 7/2001 | Li et al. | 439/66 |

* cited by examiner

*Primary Examiner*—Truc T. T. Nguyen
(74) *Attorney, Agent, or Firm*—Nawrocki, Rooney & Sivertson, P.A.

(57) ABSTRACT

The present invention includes an interconnect contact and system. The contact generally includes a first contact element, a second contact element, and a biasing member. The first contact element has a contacting surface and an engagement surface. The second contact element has a contacting surface and an engagement surface. The engagement surfaces of the elements are generally constructed to contact each other. The biasing member provides a mechanism to move at least one element of the contact.

8 Claims, 7 Drawing Sheets

ELECTRICAL CONNECTOR WITH RESILIENT CONTACT

This application claims the benefit of Provisional Application No. 60/374,091, filed Apr. 19, 2002.

TECHNICAL FIELD

The present invention deals broadly with the field of electrical interconnect systems, and relates generally to technology, for example, for interconnecting a lead of an integrated circuit device with a corresponding terminal on a printed circuit board interfacing with a test apparatus intended to effect test analysis of the integrated circuit device.

BACKGROUND OF INVENTION

A plethora of applications exist for effecting electrical contact between two conductors. One significant application is effecting interconnection between leads of an integrated circuit device and conductive pads or terminals on a printed circuit (PC) board, which serves to create electrical contact between the integrated circuit (IC) device and a test apparatus. Such apparatus are used to evaluate performance of integrated circuit devices.

Numerous considerations bear upon the structure employed to interconnect the IC and the PC board. These factors include both electrical and mechanical considerations. For typical interconnection systems, special attention must be given to electrical performance, including self inductance and capacitance, the life span requirements, issues of repairability or replacability, the operation temperature environment, coplanarity of the device terminals, mechanical manufacturing limitations, and device alignment, including terminal orientation relative to the interconnection system.

In a typical semiconductor production facility, each IC is tested using a test apparatus. The test apparatus may be connected to an interconnection system wherein the leads of an IC are connected to a PC board within the interconnection system. The PC board may then be controlled by the test apparatus for testing the IC.

The test apparatus may test the functionality and performance of an IC through the interconnection system. Due to manufacturing process variations, some of the IC's may perform at a higher level than other IC's. Therefore, the test apparatus may be used to sort the devices according to their performance characteristics. This is termed "speed grading". Typically, the higher performance IC's will receive a premium price in the market place. It can readily be seen that it is important that the interconnection system not distort the performance characteristics of the IC under test. If it does, the IC manufacturer may lose a substantial amount of revenue.

One objective of an interconnection system is to maintain a "non-distorting electrical interconnection" between the test apparatus and the IC as discussed above. To accomplish this, it is a goal of an interconnection system to have low lead inductance/resistance, low lead-to-lead capacitance, low lead-to-ground capacitance, and a high electrical decoupling factor. These characteristics all reduce the "distorting" nature of the electrical interconnection system.

Another objective of the interconnection system is to maintain a consistent and reliable electrical interconnection over many test cycles. In conventional interconnection systems, the contact resistance of the interconnection system may change after continued use. A cause of this resistance change may be solder buildup on the contacts within the interconnection system. Increased contact resistance can distort the performance of the IC and thus reduce the test yield realized.

Because of tolerances in the manufacturing process, all of the leads of a semiconductor package may not be coplanar. For similar reasons, contacts of the interconnection system itself may not be fully coplanar. Therefore, when the IC and the interconnection system are brought into engagement, some of the leads of the IC package may not be adequately contacted to corresponding contacts within the interconnection system. It is a goal of the interconnection system to compensate for these non-coplanarities.

To accomplish this, the interconnection system may comprise interconnection contact elements wherein the IC package leads contact and depress a corresponding contact in the interconnection system until the remaining package leads come into engagement with corresponding contacts. An advantage of this arrangement is that the movable contact elements allow each semiconductor lead to have a force applied thereon which falls within an acceptable range to establish a gas-tight connection, despite any non-coplanarity of the semiconductor package and interconnection system.

One prior art structure that seeks to accomplish the purpose of the present invention is a pogo-pin configuration. A pogo-pin configuration typically consists of a contact tip, a shaft, a barrel, and a spring. The shaft is enclosed within the barrel and biased by the spring to an upward position. Located at the upper tip of the shaft is the contact tip for contacting the lead of a semiconductor package. The shaft generally makes electrical contact with the barrel, and the lower portion of the barrel is connected to a PC board. As a semiconductor package lead comes into contact with the contact tip, the spring allows the shaft to depress downward into the barrel while still maintaining electrical contact with the barrel. The semiconductor package is forced down on the pogo-pins until all of the semiconductor package leads have an appropriate force thereon.

Although the pogo-pin configuration solves some of the problems discussed above, the leads are generally long and therefore inject a substantial amount of inductance into the interconnection system. Because of this relatively high level of inductance, the pogo-pin configuration may generally be limited to medium to low speed applications. Additionally, the piercing action utilized by the pogo-pin to make contact with a device (i.e., the action produced by the spring action applied to a small area) can be detrimental to the solderability later in the production process.

Another prior art structure that seeks to accomplish the purpose of the present invention is known as the Yamaichi contact. This type of contact includes an inverted L-shaped support having a cantilevered contacting portion mounted at the distal end of a generally horizontal leg of the inverted, L-shaped support and extending generally parallel to that leg. The distal end of the contacting portion is upwardly turned so that a point thereof is engageable by a lead of an IC device to be contacted. The support, in turn, is engaged in some manner with or through a pad or terminal portion of a printed circuit board. Problems that have been observed with the Yamaichi contact include solder buildup, difficulty of construction, and high inductance. In addition, the Yamaichi contact relies on the flexure of the contact material that creates an offset between the input/output feature on the IC under test and the circuit board.

Another type of structure that seeks to accomplish the purpose of the present invention is a fuzz button contact. A fuzz button contact typically consists of a specially designed array of resilient knitted wire mesh that is retained within a housing mounted to a PC board. The lead of a semiconductor package may be received by the housing, wherein the wire mesh forms a connection therewith. The fuzz button contact allows for some degree of compression that helps compensate for the non-coplanarity of the semiconductor package and the interconnection system. Due to the close contact of the wire mesh, a low resistance/inductance connection can be realized between the PC board and a lead of the semiconductor device. Typical problems with the fuzz button contact include the loss of compliance of the wire mesh after continued use. Furthermore, the wires within the wire mesh may become fatigued and eventually break. Finally, the wire mesh may become undesirably deformed, particularly if the fuzz button is over compressed. All of these problems limit the reliability and life expectancy of the fuzz button contact configuration.

Another prior art structure that seeks to accomplish the purpose of the present invention is a wire contact. A wire contact consists of a wire that is held in place by a housing. A first end of the wire is in contact with a PC board, and a second end of the wire is in contact with a lead of a semiconductor package. As the lead of the semiconductor package is forced down upon the second end of the wire, the center portion of the wire is bent in a lateral direction. The properties of the wire may be selected to provide the desired stiffness and deflection force.

Yet another prior art structure is a solid post contact (i.e., a conductive block or cylinder). Although electrical performance afforded is superior, such structures typically do not provide z-axis compliance or scrub. This puts the IC at risk for damage or signal degradation.

It thus remains highly desirable to provide a device that improves upon known methods, techniques and devices by providing: compliance in the z-axis, horizontal translation, large contact surface, and compact size. It is to these dictates and shortcomings of the prior art that the present invention is directed.

SUMMARY OF THE INVENTION

An interconnect contact device having cooperatively interfacing first and second contact elements and a resilient member disposed relative to the elements such that the resilient member biases the first contact element into engagement against the second contact element for responsive displacement of the first contact relative to the second contact element. Embodiments of the invention may be constructed to provide a wiping action at the cooperative interface between the elements and their connections to other devices. The device thereby provides for an integrated circuit connected thereto: compliance in the z-axis, horizontal translation, a large contact surface, and a compact size.

More specific features and advantages will become apparent with reference to the DETAILED DESCRIPTION OF THE INVENTION, appended claims, and the accompanying drawing figures.

DETAILED DESCRIPTION OF THE DRAWINGS

Figure 1:
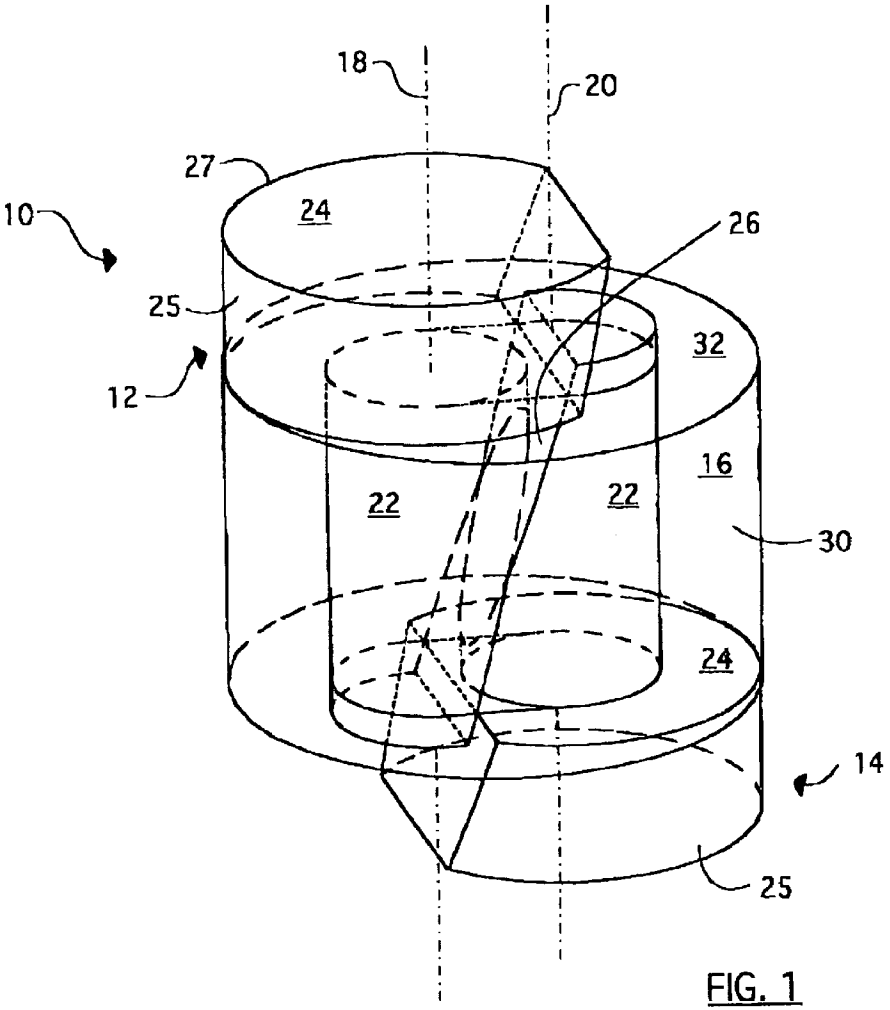
FIG. 1 is a front perspective view of the interconnect contact of the subject invention.
Figure 2:
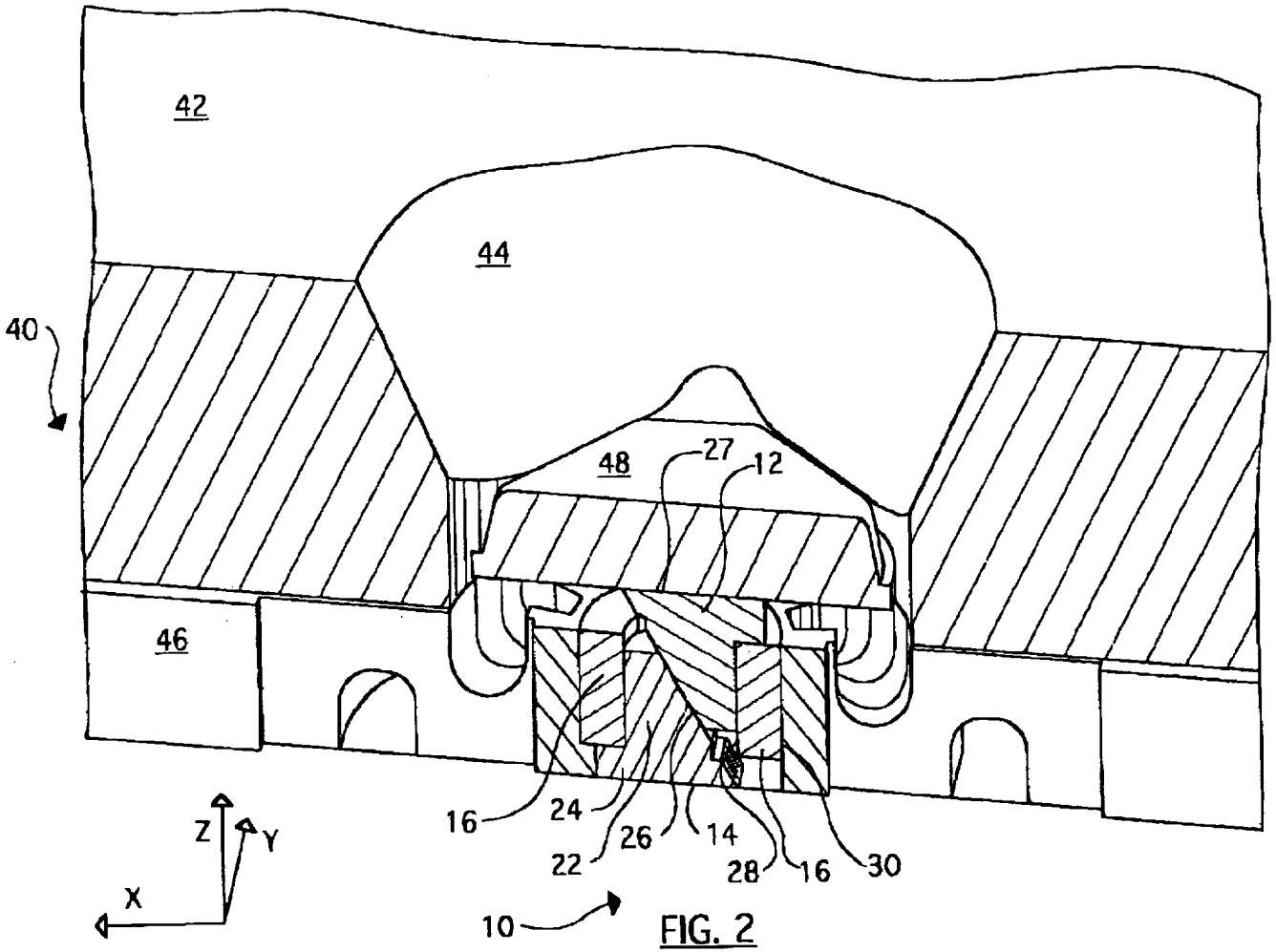
FIG. 2 is a sectional view of a device test apparatus outfitted with an interconnect contact of the subject invention as used in a ground application, particularly illustrating a device under test in initial, partial engagement with the contact.

A simplified embodiment of the structure of the present interconnect contact device is generally presented and best seen in FIG. 1, with its relationship to a test apparatus best seen in FIG. 2. The general operation and function of the contact device is best understood from a comparison of FIG. 3, wherein the device is shown in a "passive" state (i.e., no load applied), and FIG. 4, wherein the device is shown in an "active" state (i.e., under a load).

Referring to FIG. 1, the interconnect contact device 10 includes, in its most general sense, cooperatively interfacing first 12 and second 14 conductive contact elements. A biasing member 16 resiliently presses the first contact element 12 against the second contact element 14. Contact element 12 can slide with respect to contact element 14 so as to accomplish a wiping action therebetween.

It may be fairly said that the cooperating first 12 and second 14 contact elements of the device 10, as shown in the "passive" condition or state of FIG. 1, somewhat resemble an obliquely bisected (i.e., from the bottom left to top right as shown in FIG. 1) aligned spool or dumbbell whose halves laterally shift (i.e., the sides of each element move generally out of or into axial alignment). Contact elements 12 and 14 may be similar, with the device 10 being configured such that one contact element is simply the inversion of the other with one substantially but not necessarily directly atop and in substantial alignment with the other contact element, when the device is in its passive condition. A biasing member 16 is positioned about the interfacing contact elements 12 and 14 to maintain this engagement of the contact elements 12 and 14.

First contact element 12 has a first axis 18 and second contact element 14 has a second axis 20. Each of the elements 12 and 14 include joined body 22 and base 24 components that can be cylindrical in shape, as shown. Each base 24 is preferably larger in diameter than the body 22 of its contact member 12 or 14 and is aligned vertically therewith along the respective axes 18 and 20. The upper surface of contact member 12's base 24 has a contact surface 27. Surface 27 can make contact with a lead of a device to be tested.

The bodies 22 of the contact elements 12 and 14 engage each other to thereby generally form a cooperative interface therebetween. The bases 24 engage and indirectly conductively join via the cooperative interface, the contact or lead of a device for test, and of a test board for example. In all cases, the base 24 of each contact element 12 and 14 preferably extends farther from its axis 18 or 20 than the body 22, and is preferably integral with the body 22.

In addition to body 22 and base 24 components, each contact element 12 and 14 has an engagement surface 26 obliquely extending and in partial alignment, relative to the elements' axes 18 and 20, across its body 22. Extension of the engagement surface 26 preferably continues across the base 24 of the contact element 12 or 14. The engagement of the partially aligning oblique faces 26 form or define a cooperative interface between the first 12 and second 14 contact elements.

Resilient biasing member 16 holds faces 26 in contact with each other. Resilient member 16 has a cavity within itself defined by an inner surface or wall 28. The cavity has an axis parallel to element axes 18 and 20. In some embodiments, such as those shown in FIGS. 1–7, the resilient member 16 is generally band-like (as illustrated), and can be tubular in character, having an inner wall or surface 28 (FIGS. 2–4) engaging the contact elements 12 and 14, and an outer surface 30. The objective of the resilient member 16 is to maintain the orientation of the cooperatively interfacing first and second contact elements and to bias elements 12 and 14 to their "passive" condition. That is, resilient member 16 urges element 12 to slip along axis 18 so that axis 18 separates from axis 20 and smaller areas of the oblique surfaces 26 contact.

The resilient member 16, which is preferably an elastomeric material such as silicon rubber or polyethylene, may be positioned about the contact element bodies 22 to stretch or expand or, in an alternate embodiment, may be positioned next to and under one of the contacts 12 or 14 to be compressed. Responsive displacement of one contact element 12 or 14 relative to the other can thereby occur, and the many benefits accruing therefrom (as discussed with respect to FIGS. 3 & 4) can be achieved.

Figure 4:
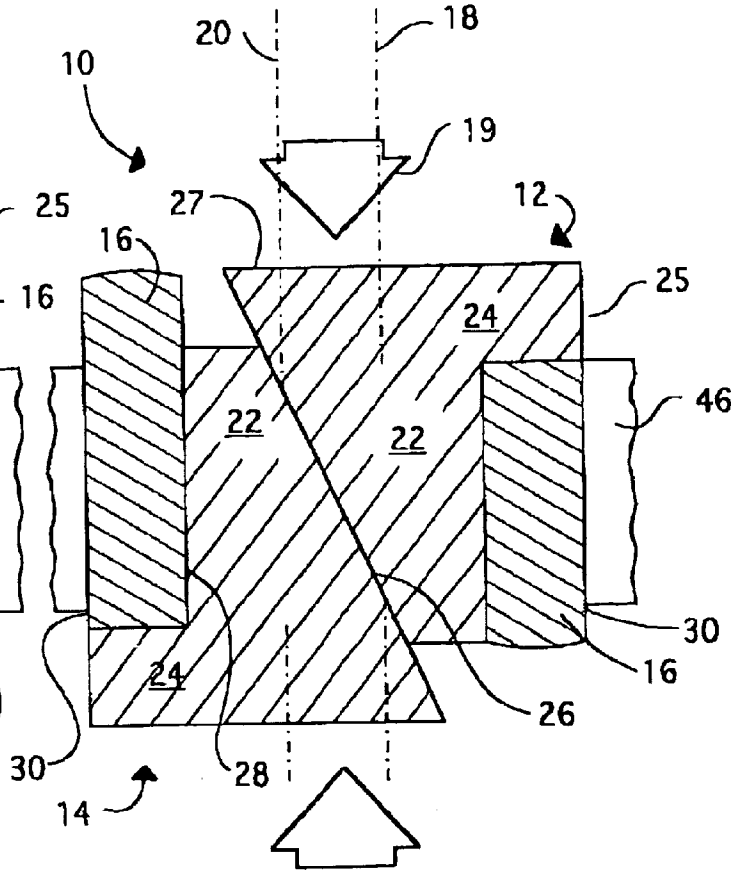
FIG. 4 is a sectional view of the interconnect ground contact of the apparatus of FIG. 2, particularly illustrating the relationships between the contact elements while in an "active" condition.
Figure 3:
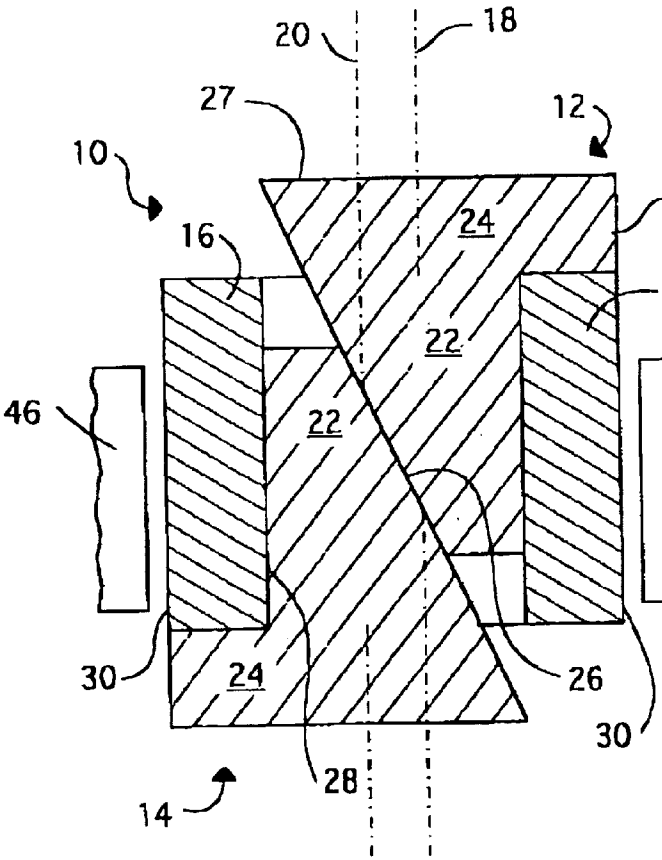
FIG. 3 is a sectional view of the interconnect ground contact of the apparatus of FIG. 2, particularly illustrating the relationships between the contact elements while in a "passive" condition.

Preferably, the resilient member 16 is dimensioned such that its outer surface 30 is in substantial vertical alignment with the base "facing" 25 as shown in FIGS. 2–4. That is, (the maximum dimension, in this case the outer radius of the resilient member 16 is preferably about equal to the maximum dimension of the base components 24 of each of the contact elements 12 and 14. When element 12 translates downward along axis 18 with respect to element 14, element 12 also shifts laterally and deflects or stretches member 16. One significant advantage of this arrangement is to provide a wiping action between surface 27 and a lead from a device under test as force is applied along the cavity axis parallel to axes 18 and 20.

Referring to FIG. 2, the contact device 10 is shown as part of a test assembly 40, which orients the invention with respect to the surface to which the test assembly is mounted. The assembly 40 also supports and orients the contact elements 12 and 14 relative to the IC device to be inserted into the assembly for testing purposes. Generally, the assembly 40 includes an alignment plate 42 having a socket 44 for receiving an IC intended for testing, an underlying housing or layer 46 in this case overlying a PC board (not shown), and the contact device 10 positioned for conductively joining a device 48 under test within the socket 44 to the PC board. As shown, the device 48 under test typically initially engages the surface 27 of first contact element 12 of the device 10.

Referring to FIGS. 3 & 4, the interconnect contact device 10 is shown in cross section. Upon insertion, the I/O components of the IC impinge on the first (i.e., "upper") contact element 12 of the device 10, and specifically the base 24 thereof. As the IC is pressed into the assembly, denoted in FIG. 4 by the downward pointing upper arrowhead, the first contact element 12 is forced to slide down and across the planar face or surface 26 of the second (i.e., "lower") contact element 14, which is stationary due to its abutment with and conductive communication with a PC board (not shown).

Although the face 26 for each contact element 12 and 14 generally extends across the body 22 thereof, it preferably extends across both the body 22 and the base 24 components, depending upon specific application objectives and constraints. With such a configuration, there exists, during back and forth sliding of the first contact element 12 upon the second contact element 14, clearance for the first element 12 body component 22 relative to the second contact element 14 to permit a maximum sliding travel distance for the first contact element 12. As the first contact element 12 slides across the second element 14, z-axis compliance along axis 18 occurs, as well as x-axis lateral translation in the plane of the lower surface of the IC. The diagonal sliding or "wiping" motion affords two benefits: z-axis (vertical) compliance that protects the IC from damage that might otherwise occur if the contact element or elements were rigid, and the horizontal x-axis translation that scrubs the I/O component of the IC to clean the element and/or I/O component of debris and oxides that might degrade electrical signal quality.

As is noted by comparison of FIGS. 3 & 4, when the IC engages with the contact device 10 (i.e., enters the "active" state of FIG. 4), the resilient biasing member 16 is forced to deform or deflect outwardly as the contact element 12 that is "constrained" within the resilient member 16 shifts laterally. That is, in going from a passive to an active condition, the axes 18 and 20 of the contact elements 12 and 14 are driven apart to laterally expand or stretch the resilient member 16. Upon conclusion of testing and removal of the IC from the socket 44, elements 12 and 14 slip relative to each other along their respective axes 18 and 20. Axes 18 and 20 move towards each other to their original positions and the contact device 10 returns to the passive state of FIG. 3 under the lateral force applied by the stretched resilient member 16 returning to the unstretched state. When stretched, resilient member 16 applies lateral force to bodies 22 and thereby urging first and second contact elements 12 and 14 to return to their passive, at-rest positions of FIG. 3.

Figure 6:
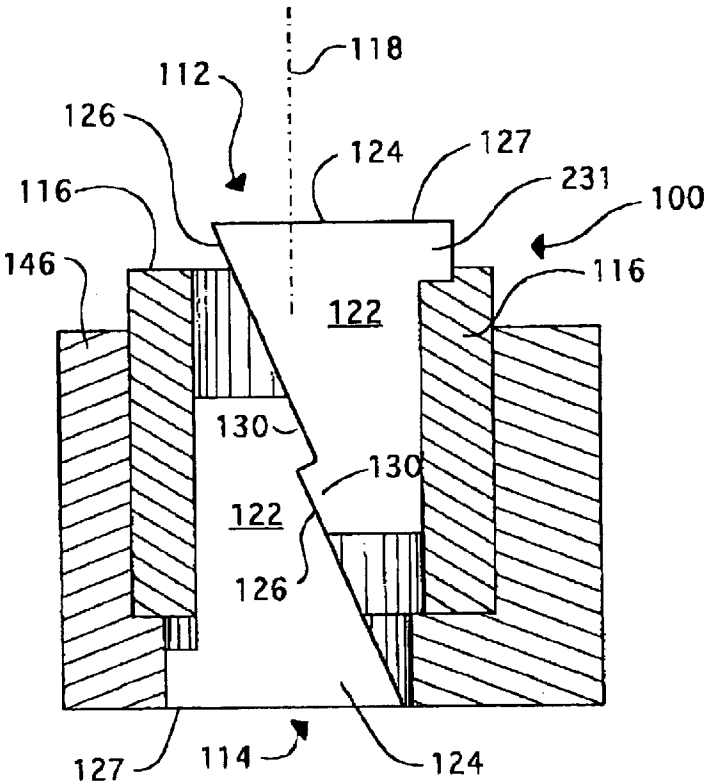
FIG. 6 is a sectional side view of the embodiment of FIG. 5.
Figure 5:
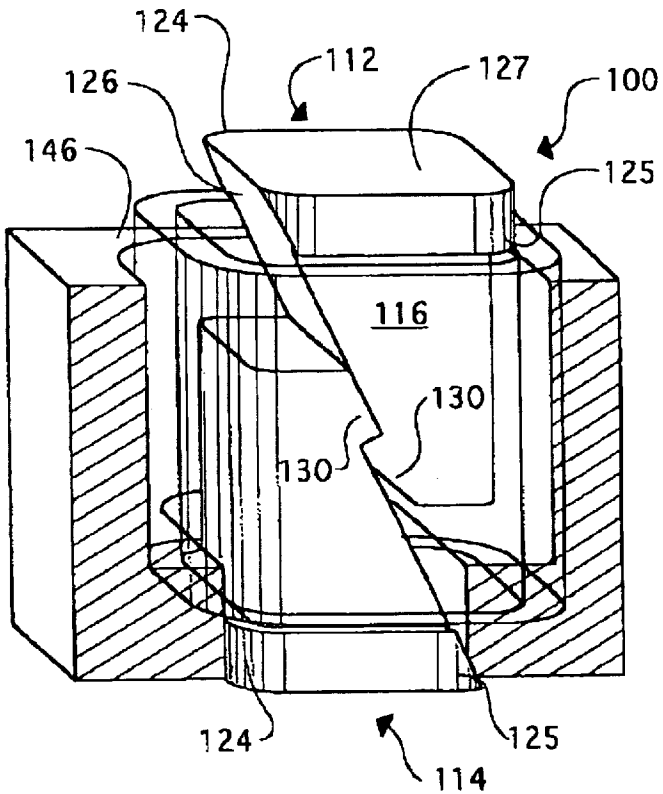
FIG. 5 is an elevated side view of another embodiment of the present invention.
Figure 7:
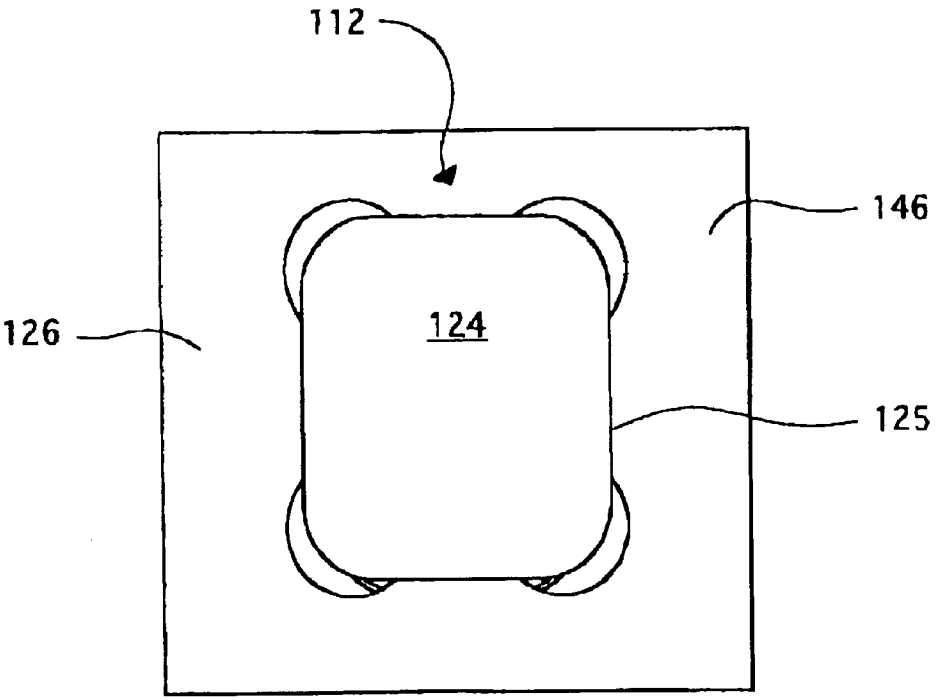
FIG. 7 is a bottom elevation view of the embodiment of FIG. 5.

FIGS. 5–7 provide another embodiment of the present invention. As with the embodiment shown in FIGS. 1–4, the system includes an apparatus 100 generally comprised of first and second conductive contact elements 112 and 114 and a resilient biasing element 116. Each conductive contact element 112 and 114 has a base 124, a vertical surface 125, and a joined body 122 with an oblique or diagonal engagement face 126 and a contact face 127. The system constructed according to the present invention also includes a housing 146 providing a cavity therein for holding apparatus 100. A test element contact (not shown) is to be pressed against contact face 127 of element 112 with force generally directed along a cavity axis 118.

Although not necessary for every embodiment, the elements 112 and 114 may have a base 124 that is larger in circumference than the general circumference of the joined body 122. Accordingly, the base 124 has a face 125 with a larger circumference than joined body 122. This feature restricts the lateral movement of the elements 112 and 114 such that they laterally move with respect to each other only when also moving in the z-axis direction along cavity axis 118. Further, each base 124 of the elements 112 and 114 interacts with a surface of the system such that the contact elements 112 and 114 cannot move past a certain predefined point in the z-axis direction along cavity axis 118. For example, as shown in FIGS. 5 and 6 with respect to contact element 112, the enlarged base 124 and face 125 of element 112 interact with the edge of the resilient biasing member 116 and, with respect to contact element 114, a surface of the housing 146.

Additionally, each element may have a retaining projection or lug 130 formed along face 126 that cooperate with each other to provide a stop structure. The lug 130 of the first element 112 abuts the surface of the lug 130 on the second element 114 to restrict the movement of the elements 112 and 114, both laterally and in the z-axis direction along axis 118, and thereby restricts the vertical position of the element 112 contact surface 127 and its lateral movement. In this embodiment, as in FIGS. 1–4, the resilient biasing member 116 surrounds the contact element bodies 122.

The biasing member 116 of this type may be formed around the elements 112 and 114 such that the elements 112 and 114 substantially fill the interior cavity of the biasing member 116 or, alternatively, may be formed having a generally cylindrical aperture in the interior of the biasing member 116 wherein the elements 112 and 114 are placed. The housing 146, surrounding the contact 100, is sized and shaped to receive the biasing member 116. The tightness of the fit of the device 100 with the housing 146 and the amount of resilience of the biasing member 116 may be changed dependent upon the specific requirements of the system and, therefore, those skilled in the art will choose these according to the specific application.

Preferably, the device 100 should fit snugly enough into the housing 146 cavity such that there is no lateral or z-axis movement or slippage of the biasing member 116 with respect to the housing 146. However, it is also conceivable and within the purview of this invention that the biasing member 116 may be fixed within the housing 146 by adhesive or other means known in the art.

Z-axis force along cavity axis 118 applied to element 112 contact surface 127 causes lugs 130 to slip apart from each other and element 112 contact surface 127 to move closer to contact element 114. When force is removed from element 112 contact surface 127, lateral force provided by biasing member 116 causes lugs 130 to slip back into contact with each other and element 112 contact surface 127 to move away from contact element 114.

In another embodiment, shown in FIGS, 8–10, the system also has some similar components to the embodiment shown in FIGS. 1–4. For example, the device 200 is generally comprised of first and second elements 212 and 214 held within the walls of a cavity in a housing member 246. Element 214 may be considered to form an end of this cavity as well as being contained therein.

Figure 8:
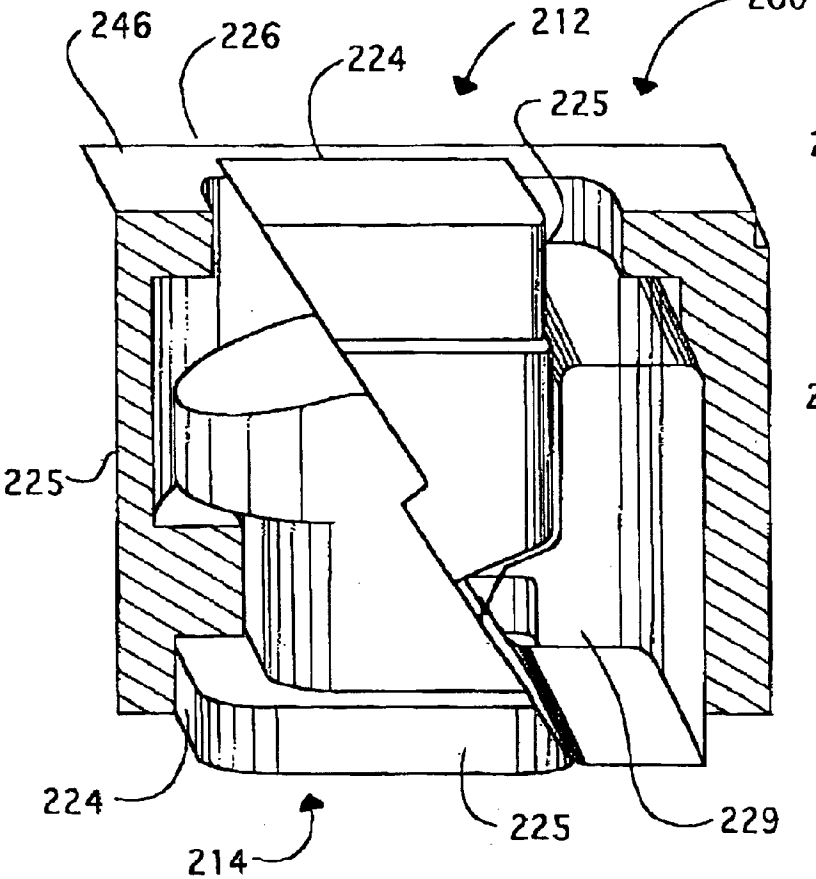
FIG. 8 is an elevated side view of another embodiment of the present invention.

Each of the elements 212 and 214 has a base 224, a facing 225, and a joined body 222 having an oblique surface 226. Element 214 has a contact surface 227 shown on edge in FIG. 9. A cavity axis 228 is approximately parallel to the outwardly facing walls of elements 212 and 214. FIGS. 8 and 10 show a generally rectangular shape for elements 212 and 214. Base 224 of element 214 forms an end for the cavity containing elements 212 and 214.

As with the embodiment shown in FIGS. 5–7, although not necessary for every embodiment, the elements 212 and 214 may have a portion of the facing 225 that is larger in circumference than the general circumference of the joined body 222. In this embodiment, this feature allows for the engagement of a portion of the facing 225 with the interior surface of the housing 246 without the engagement of the entire facing 225. Further, this feature restricts the contraction and/or, as in this case, the extension of the elements 212 and 214 such that they cannot contract toward each other or extend, past a certain predefined point. For example, as shown, both the first and second elements 212 and 214 have at least one larger facing portion 225 thereon. The facings 225, or more specifically the edges formed thereby, each abut against a surface of another component.

In particular, the edge formed by the transition from the smaller circumference of the body 222 and the facing 225 of the first element 212 abuts against the interior of the housing 246, thereby restricting extension of the elements 212 and 214, while the edges formed by the transition from the smaller circumference of the body 222 and the facings 225 of the second element 214 abut against other surfaces of the housing 246, one facing edge restricting the extension of the contact elements 212 and 214 and the other facing edge restricting the contraction of the elements 212 and 214. These structures act to form stop structures to stop the movement of the contact element in the lateral and/or z-axis.

Additionally, the elements 212 and 214 may have a lug 230 projecting from face 226. As in the embodiment of FIGS. 5–7, the lugs 230 act to restrict the movement of the contact elements 212 and 214.

A biasing member or resilient element 216 in this embodiment is positioned both laterally with respect to the second element 214 such that the biasing member 216 is in contact with both the side and the bottom of the element 212. When element 216 is compressed by force applied along cavity axis 228 against surface 227, lugs 230 move apart. Contact surface 227 moves closer to element 214, and also moves laterally due to the oblique angle of surfaces 226. The compression of element 216 biased first element 212 to press against and mechanically and electrically engage the second contact 214.

The dimensions of the contact device, particularly the base diameters of the contact element engagement areas, are predicated upon the package and its pad size. However, each of the base components of the contact elements provides an appreciable contact area for the IC and PC board, particularly when compared to pogo-pins, etc.

Figure 9:
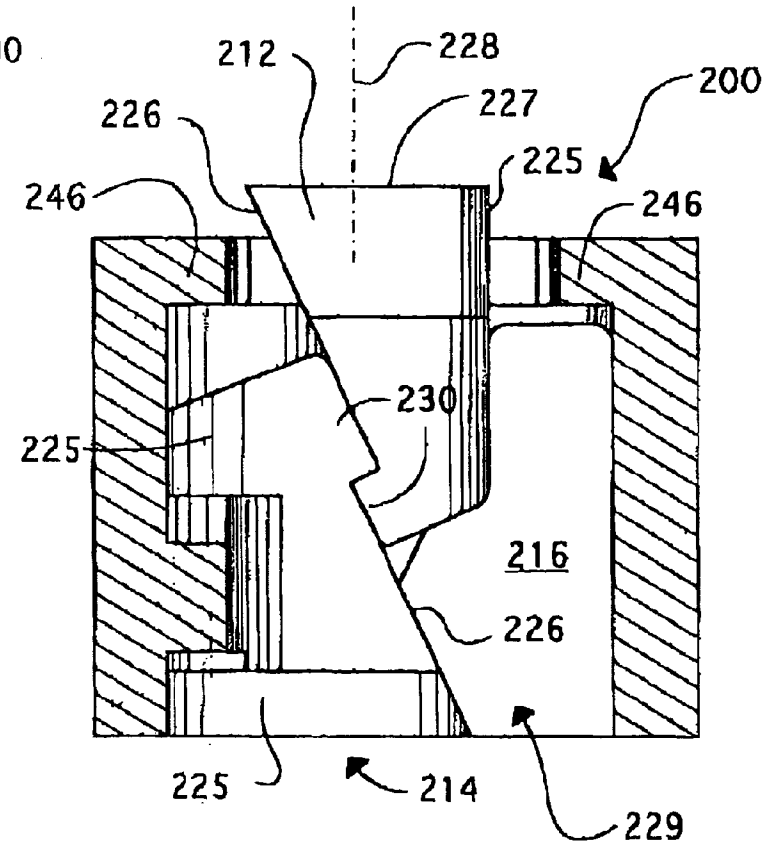
FIG. 9 is a sectional side view of the embodiment of FIG. 8.
Figure 10:
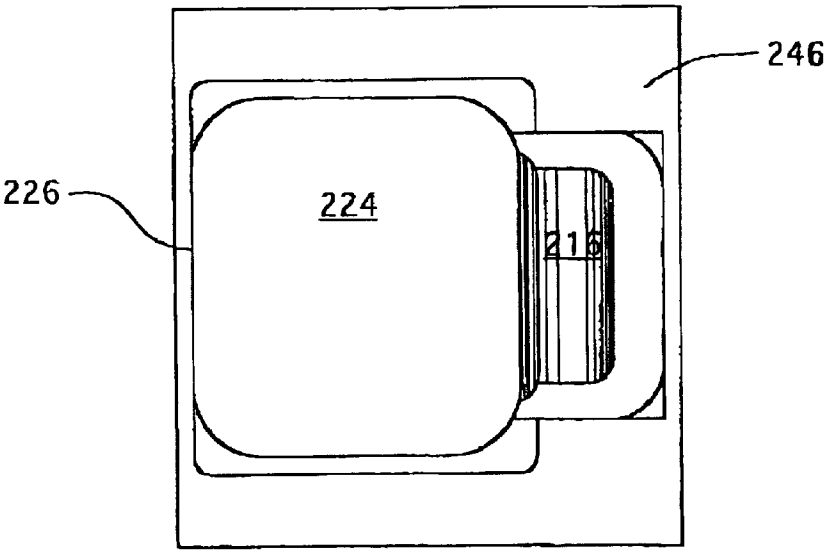
FIG. 10 is a bottom elevation view of the embodiment of FIG. 8.

The portion 229 of resilient element 216 acts on the bottom end of element 212 to provide restoring force returning element 212 to the position shown in FIGS. 8 and 9 when force is removed from surface 227. This memory characteristic of the resilient element 216 material allows repeated cycles of compression and decompression as is necessary for a test fixture contact.

The contact elements are preferably fabricated from a beryllium/copper (Be/Cu) composite, although other known conducting materials are likewise contemplated and embraced. In some cases, the contact elements may be of dissimilar materials to avoid welding or spalling of one against the other. Because friction should be minimized between them, we prefer the surface finish between the contact surfaces to be less than 16 $\mu$in. Often a lubricant on surfaces 126 may interfere with the electrical conduction between them, so for this reason one should be cautious when providing lubrication here.

Oblique surfaces 226 may have an angle with respect to the cavity axis 228 of approximately 30°, although a range of approximately 20° to 45° may be suitable in certain situations. The angle chosen depends on the coefficients of friction between elements 212 and 214 and between element 212 and member 216, as well as on the dimensions and the restoring forces for member 216.

The biasing member 216 is illustrated as being generally the shape of a backward L so as to directly provide restoring force to the end of element 212 opposite surface 227. Such a shape is not however required. The restoring force can also be provided only by a volume of member 216 bearing on a flange or lug 231 or bearing on the end of element 212.

The biasing member 216 may be of any resilient material or structure that provides force when distorted sufficient to bias a portion of the contact. One suitable example is an elastomeric material having a silicone base with a durometer value of 40–70. The elastomeric material should have good memory characteristics even when subjected to moderately high temperatures arising during a typical IC circuit test. Although not presently preferred, member 216 could also comprise a metallic or resilient plastic leaf spring design that provides both lateral and restoring forces to element 212.

In addition to the previously noted functions of maintaining the positioning of the contact elements and providing upward and compressive radial forces to the elements, biasing member 216 further shields the sliding surfaces of the contact elements from debris. This enables a high degree of isolation of the device to thereby minimize cross talk.

It will be understood that this disclosure, in many respects, is only illustrative. Changes may be made in details, particularly in matters of shape, size, material, and arrangement of parts without exceeding the scope of the invention. Additionally, use of terms such as top, bottom, side, height, and the like are provided to describe the embodiments shown in the figures and should not be deemed limiting. Accordingly, the scope of the invention is as defined in the language of the appended claims.

That which is claimed is:

1. A compression-type contact comprising a) a housing member having a cavity therein defined by a wall and an end, said cavity having a cavity axis, said cavity wall having a resilient portion comprising an elastomeric material, and deflecting laterally with respect to the cavity axis responsive to laterally directed force, and said cavity having elastomeric material at the end thereof and deflecting axially responsive to axially directed force;

b) a first contact element formed of conductive material, said first contact element forming a bottom of said cavity, said first contact element having a first oblique surface facing both the cavity opening and the resilient portion of the cavity wall; and c) a second contact element formed of conductive material and sized to fit within the cavity, and having a portion of the shape thereof substantially matching the laterally resilient cavity wall portion, said second contact element having a contact surface facing away from the first contact element, a second oblique surface facing the first oblique surface and substantially parallel thereto, and an inner end opposite the second contact surface, wherein each oblique surface includes a lug extending toward and contacting the facing oblique surface, each oblique surface's lug for sliding on the facing oblique surface, said lugs together forming a stop structure, said second contact element responsive to force applied to the contact surface, translating by slippage along the contact elements' oblique surfaces to deflect the laterally resilient cavity wall portion while said force is present.

2. The connector of claim 1, wherein the lug on the second oblique surface is positioned at an edge of said second oblique surface spaced from the contact surface, and the lug on the first oblique surface is positioned between the lug on the second oblique surface and the contact surface.

3. A compression-type contact comprising:

a) a housing member having a cavity therein defined by a wall and an end, said cavity having a cavity axis, and said cavity wall having a resilient portion comprising an elastomeric material, and deflecting laterally with respect to the cavity axis responsive to laterally directed force;

b) a first contact element formed of conductive material, said first contact element forming a bottom of said cavity, said first contact element having a first oblique surface facing both the cavity opening and the resilient portion of the cavity wall; and c) a second contact element formed of conductive material and sized to fit within the cavity, and having a portion of the shape thereof substantially matching the laterally resilient cavity wall portion, said second contact element having a contact surface facing away from the first contact element, and a second oblique surface facing the first oblique surface and substantially parallel thereto, said second contact element, responsive to force applied to the contact surface, translating by slippage along the contact elements' oblique surfaces to deflect the laterally resilient cavity wall portion while said force is present, wherein each oblique surface includes a lug extending toward and contacting the other oblique surface, each said oblique surface's lug for sliding on the other oblique surface, said lugs together forming a stop structure.

4. The connector of claim 3, wherein the lug on the second oblique surface is positioned at an edge of said second oblique surface spaced from the contact surface, and the lug on the first oblique surface is positioned between the lug on the second oblique surface and contact surface.

5. The connector of claim 3, wherein the second contact element has a first predetermined coefficient of friction with the first contact element and a second predetermined coefficient of friction with the cavity wall resilient portion, wherein the oblique surfaces have a predetermined angle with the cavity axis, and wherein the elastomeric material has a predetermined restoring force, wherein the predetermined first and second coefficients of friction, the predetermined oblique surface angle, and the predetermined restoring force cooperate to urge the second contact element to slip with respect to the first contact element's oblique surface upon removing force on the contact surface.

6. The connector of claim 3, wherein the first and second contact elements have a generally rectangular cross section as viewed along the cavity axis.

7. The connector of claim 3, wherein the oblique surfaces are angled at approximately 30° from the cavity axis.

8. The connector of claim 3, wherein the volume of elastomeric material has an approximate L shape having first and second arms in cross section, where one arm thereof contacts the end of the second element opposite the contact surface.

* * * * *